US006393712B1

(12) United States Patent
Jansson

(10) Patent No.: US 6,393,712 B1
(45) Date of Patent: May 28, 2002

(54) GRINDING JIG FOR GRINDING GOUGE CHISELS

(75) Inventor: Torgny Jansson, Lindesberg (SE)

(73) Assignee: Tormek AB, Lindesberg (SE)

( * ) Notice: Subject to any disclaimer, the term of this patent is extended or adjusted under 35 U.S.C. 154(b) by 0 days.

(21) Appl. No.: 09/548,054

(22) Filed: Apr. 12, 2000

Related U.S. Application Data

(63) Continuation-in-part of application No. 09/311,668, filed on May 13, 1999, now Pat. No. 6,189,225.

(51) Int. Cl.[7] ..... B23Q 3/18
(52) U.S. Cl. ..... 33/628; 451/380; 451/367
(58) Field of Search ..... 33/628, 613, 626, 33/630, 641, 568, 569, 571, 573; 451/364, 365, 369, 380, 387, 405

(56) References Cited

U.S. PATENT DOCUMENTS 264,726 A * 9/1882 Maltby ..... 451/380
277,882 A * 5/1883 Carr ..... 451/369
494,893 A * 4/1893 Ross, Jr. ..... 451/369
2,998,683 A * 9/1961 Wegener ..... 451/364
3,482,325 A * 12/1969 Mitchell ..... 33/628
6,067,721 A * 5/2000 Dall'Aglio et al. ..... 33/555.1

* cited by examiner

*Primary Examiner*—Christopher W. Fulton
(74) *Attorney, Agent, or Firm*—John Lezdey

(57) ABSTRACT

A jig for grinding gouges in cooperation with a grindstone or the like. The jig includes a support, which can be fixed positionally in relation to the grindstone. The support includes a supportive part that extends generally parallel to the grindstone axle. A bearing sleeve is mounted on the supportive part for pivotal movement in a plane generally perpendicular to the grindstone axle. A rod is included for displacement in the plane of the bearing sleeve. The rod includes a pivotal locking stirrup for locking the gouge to the jig.

8 Claims, 2 Drawing Sheets

GRINDING JIG FOR GRINDING GOUGE CHISELS

This application is a continuation-in-part of Ser. No. 09/311,668 filed May 13, 1999 now U.S. Pat. No. 6,189,225.

BACKGROUND OF THE INVENTION

1. Field of the Invention

The present invention relates to a grinding jig for grinding gouge chisels.

2. Description of the Prior Art

Finger-shaped turning gouges, firming gouges, scribing gouges, etc., are very difficult to grind. The gouges are normally ground straight when received from the supplier, and are therefore often unsuitable for the purpose intended, necessitating the user to re-grind the gouges.

The gouges are often ground in freehand, using a high-speed grinding wheel (dry grinding) or a grinding stone in water. Generally, uniform grinding of the gouges is achieved with the aid of a hand-held device, in which the gouge is clamped supported solely by one leg against the floor in front of the grindstone. It is quite impossible to finger-grind a gouge precisely and symmetrically with the aid of this tool.

An object of the present invention is to solve the problem of grinding gouges, and then particularly so-called finger-shaped turning gouges, and also to enable the beveled surface that defines the cutting edge of the gouge a straight or a convex configuration in addition to the concave configuration afforded by the radius of the grindstone.

SUMMARY OF THE INVENTION

This object is achieved with an inventive grinding jig for grinding gouges in cooperation with a grindstone. The grindstone has an axle. The jig contains a support, which is fixed positionally in relation to the grindstone. The support includes a supportive part that extends substantially parallel to the axle. A bearing sleeve is mounted on the supportive part for pivotal movement in a plane substantially perpendicular to the axle. The jig further includes a rod, which is displaceable in the plane of the sleeve and a pivotal locking stirrup for locking the gouge to the jig. The stirrup is lockably mounted in a multiplicity of positions on the end of the rod that is proximal to the stone.

BRIEF DESCRIPTION OF THE DRAWINGS

The invention will now be described in more detail with reference to an exemplifying embodiment thereof and also with reference to the accompanying drawings, in which.

DESCRIPTION OF THE PREFERRED EMBODIMENTS

Figure 1A:
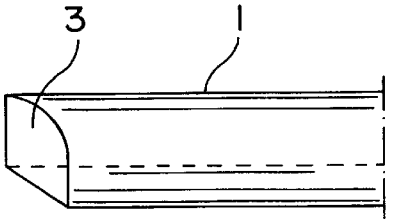
FIGS. 1*a–c* show the tip of a gouge respectively in side view, in longitudinal sectional view, and from above, and illustrate the gouge tip in the state in which it leaves the supplier, normally ground straight.
Figure 1B:
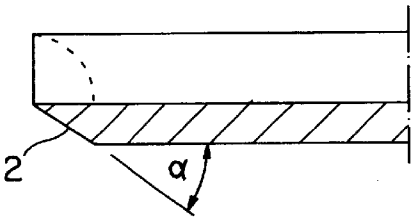
Figure 1C:
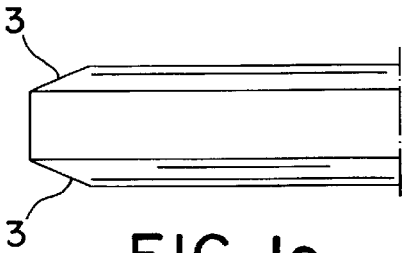

FIGS. 1*a–c* illustrate the tip of a gouge, or turning gouge (1), in the same state as that in which it is normally delivered by the supplier. The illustrated gouge has obliquely ground surfaces (2) which define the cutting angle a of the gouge, and two surfaces (3) ground on the sides of the gouge and forming its so-called side bevels. It is often desirable to grind the gouge to a so-called finger configuration, so as to enhance its usefulness. One such finger configuration is shown in FIG. 2. In this case, the gouge is ground by rotating the gouge during the grinding process so that both obliquely ground surfaces (2) defining the gouge cutting angle, and the side bevels are produced continuously.

The invention enables a gouge to be ground in this way in a simple manner and with great precision.

Figure 5:
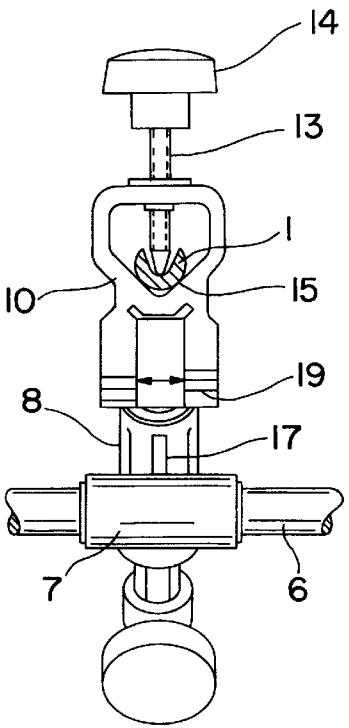
FIG. 5 is a front view of the jig shown in FIG. 4.
Figure 4:
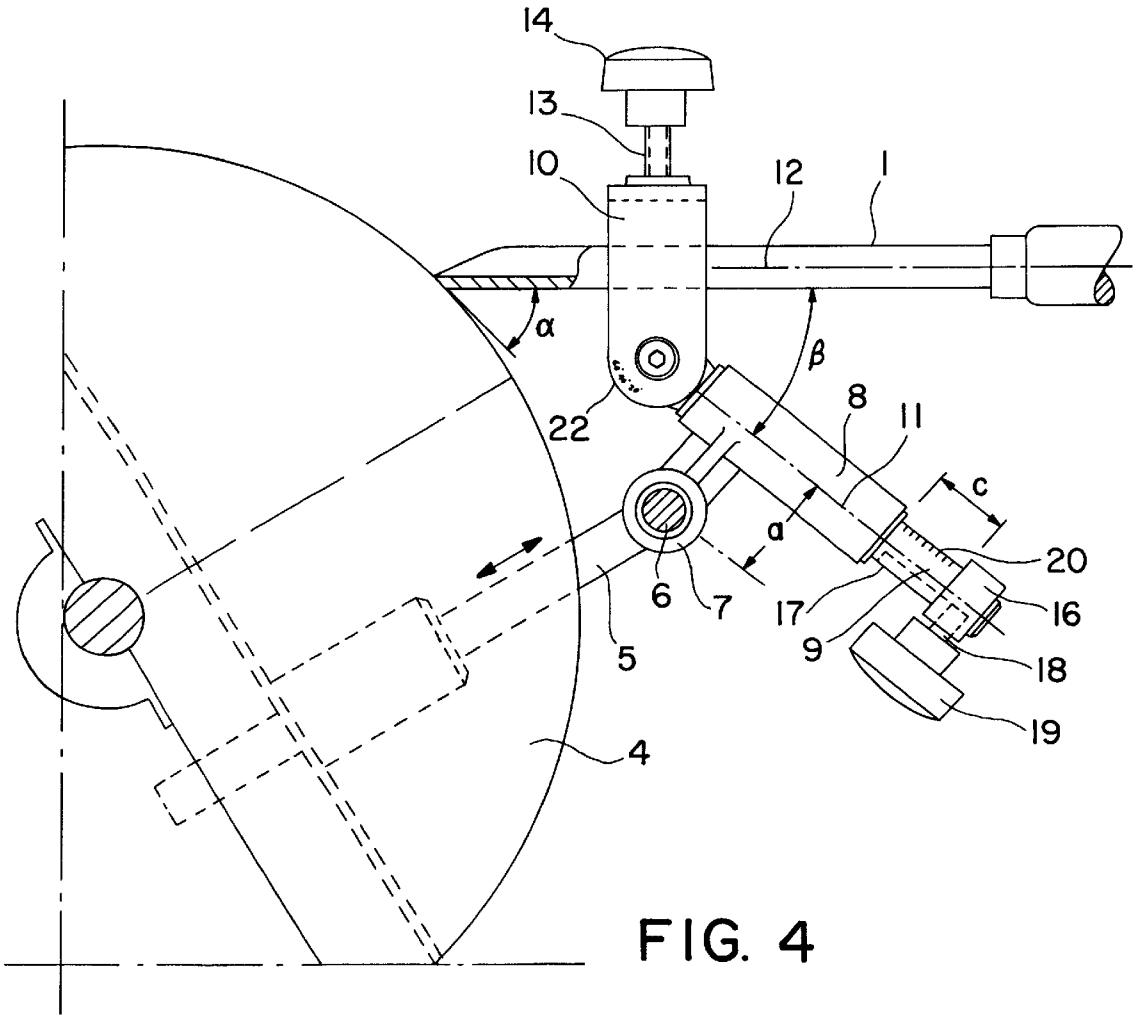
FIG. 4 illustrates a grinding jig constructed in accordance with the invention.

FIGS. 4 and 5 illustrate an inventive grinding jig for grinding a gouge (1) to a finger configuration. FIG. 4 shows part of a grindstone (4) and a raisable and lowerable universal support (5) located adjacent the grindstone mounting. The universal support includes a part (6), which extends parallel with the grindstone axle in a known manner. A sleeve (8), which includes a journal bearing (7), is pivotally and displaceable carried by the part (6) of the universal support that extends parallel with the grindstone axle. As will be seen from FIG. 4, the journal bearing (7) is placed beneath the sleeve (8) at a distance a therefrom, so that the gouge (1) can be twisted and therewith ground at an angle of at least 180°. The sleeve (8) has mounted therein a rod (9) which can be moved in the longitudinal direction of the sleeve and which projects out from the sleeve (8) at both ends thereof. A so-called locking stirrup (10) is pivotally and lockable mounted at the end of the rod (9) that lies proximal to the grindstone. The locking stirrup (10) can thus be swung relative to the longitudinal axis (11) of the rod (9) and locked in different angular positions β in relation to the longitudinal axis (12) of the gouge (1), said gouge being firmly locked in the locking stirrup (10) by means of a screw (13). The screw (13) is provided with a knob (14) and the tip of the screw functions to press the tool lockingly against a V-black (15) of the locking stirrup 10, in a positive manner.

The end of the rod (9) that lies distal from the grindstone (4) is provided with a stop ring (16), which can be moved axially along, said rod end. The rod (9) also includes an axially delimited groove (17) into which the end of a screw (18) screwed into the stop ring (16) extends. The screw (18) is conveniently integral with a knob (19), and functions to enable the locking ring (16) to be locked in different positions along the rod 9.

Figure 3:
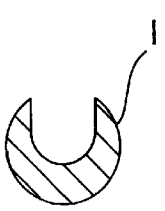
FIG. 3 is a view of the gouge profile.
Figure 2A:
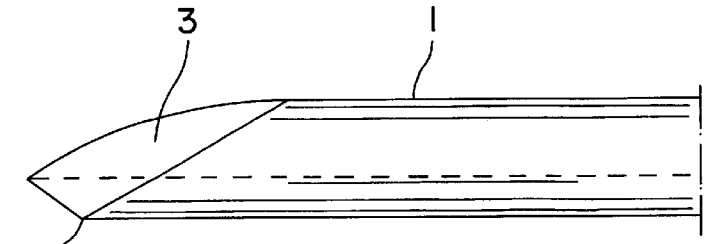
FIGS. 2*a–c* illustrate the tip of a gouge that has been finger-ground in accordance with the invention, respectively from one side of the tip, in part-section and from above.
Figure 2B:
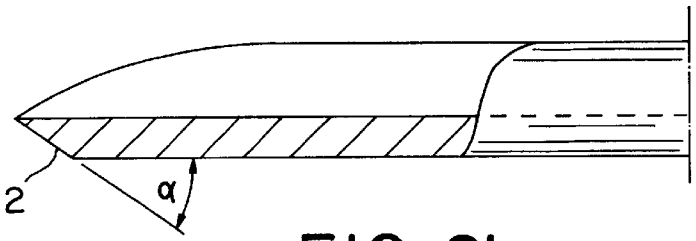
Figure 2C:
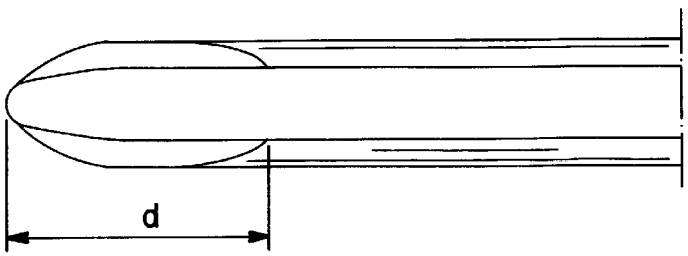

The manner in which grinding of a gouge is achieved with the aid of the inventive jig will be readily apparent from FIGS. 4 and 5. The cutting angle α is determined be the extent to which the gouge projects from the locking stirrup and by the distance of the part (6) of said universal support (5) from the grindstone. A side bevel corresponding to the side bevel shown in FIGS. 2*a–c* is obtained by twisting the locking stirrup and tool (1) around the longitudinal axis of the rod (9). The configuration of the side bevel—finger ground—i.e., its length d (see FIG. 2*c*) is determined by the angle β between the tool and the longitudinal axis (11). A suitable angle β is 20°, wherein the jig may be graduated or likewise marked for larger and smaller angles around this value, as indicated at 22 in FIGS. 4 and 5. A smaller angle will result in a shorter side bevel, whereas a larger angle will result in a longer side bevel. The side bevel will be concave in shape and will have a radius corresponding to the radius of the grindstone. However, the inventive jig can be reset quickly to obtain a straight or a convex side bevel. A convex side bevel may be desired, for instance, by lathe operators in respect of certain lathe-cutting work. Resetting of the jig is effected by first grinding the gouge with the stop ring (16)

locked in a position nearest the sleeve (8). By then moving the stop ring away from the sleeve (8), e.g. through a distance of 10–15 mm, the locking stirrup (10), with the gouge (1), can be moved in a direction towards the grindstone and the heel (21) of the cutting edge (see FIG. 2) will be ground so as to obtain the desired convex side bevel. The front edge of the cutting edge can be ground at the same time without changing the jig setting, by allowing the jig to move away from the grindstone, which takes place automatically by virtue of rotation of the grindstone. Thus, it is possible to grind the front edge of the cutting edge and the heel of the cutting edge in one and the same jig setting, thereby obtaining a more or less convex side bevel or obliquely ground surface (2), the degree of convexity being determined by the distance c set by means of the stop ring (16). The rod (9), for instance, may be provided with graduations (2*a*) to facilitate rod adjustment.

In the case of the illustrated embodiment, the locking stirrup (10) is locked to the rod (9) by means of a Philip's screw and nut, although it will be understood that other fastener means may be used, for instance a knob-carrying screw. Neither need the rod (9) be smooth as in the case of the FIGS. 4 and 5 embodiment, but may be provided with screw threads which mesh with screw threads in the bearing sleeve (8) for axial movement of the rod (9) in said sleeve, and the stop (16) may be a knob screwed onto the rod (9).

What is claimed is:

1. A jig for continuously grinding two surfaces of a gouge in cooperation with a grindstone, said grindstone having an axis, said jig comprising:

a) a raisable and lowerable support fixed positionally in relation to said grindstone so as to provide a cutting angle, said support including a supportive part that extends substantially parallel to said axis;

b) a bearing sleeve PivotTable and displaceably mounted on said supportive part for pivotal movement in a plane substantially perpendicular to said axis;

c) a rod which is displaceable inside of said sleeve; and d) a pivotal locking stirrup for locking said gouge to said jig, said stirrup being lockedly mounted in a multiplicity of positions on an end of said rod that is proximal to said stone whereby a side bevel and a front edge can be ground without changing a setting.

2. A jig for grinding gouges in cooperation with a grindstone, said grindstone having an axle, said jig comprising:

a) a support fixed positionally in relation to said grindstone, said support including a supportive part that extends substantially parallel to said axle;

b) a bearing sleeve mounted on said supportive part for pivotal movement in a plane substantially perpendicular to said axle;

c) a rod which is displaceable in said plane of said sleeve; and d) a pivotal locking stirrup for locking said gouge to said jig, said stirrup being lockedly mounted in a multiplicity of positions on the end of said rod that is proximal to said stone.

3. A jig according to claim 2, wherein said sleeve has a cavity, said cavity and said rod having screwing threads which cooperate with each other such that said rod is axially moveable through said sleeve.

4. A jig according to claim 2, wherein said rod and said stirrup include graduations which cooperate with each other for determining the angle between said rod and said stirrup.

5. A jig according to claim 2, wherein said rod includes graduations along the end of said rod that is distal to said stone for determining the position of said rod inside of said sleeve.

6. A jig according to claim 2, further comprising means for stopping said displacement of said rod, said stop means being fixedly attached to the end of said rod that is distal to said stone.

7. A jig according to claim 6, wherein said stop means include a stop ring that is axially moveable to a multiplicity of positions along said distal end of said rod.

8. A jig according to claim 7, wherein said rod has a groove and said stop means include a screw and a knob for screwing said screw through said stop ring and into said groove.

* * * * *